US005931455A

United States Patent [19]

Okui et al.

[11] Patent Number: 5,931,455

[45] Date of Patent: Aug. 3, 1999

[54] SHEET FEEDING APPARATUS AND TWO SIDE IMAGE FORMING APPARATUS THEREWITH

[75] Inventors: Susumu Okui, Hachioji; Makoto Tamura, Urawa, both of Japan

[73] Assignee: Konica Corporation, Japan

[21] Appl. No.: 08/962,367

[22] Filed: Oct. 31, 1997

[30] Foreign Application Priority Data

Nov. 6, 1996 [JP] Japan ..... 8-293656

[51] Int. Cl.[6] ..... B65H 1/08

[52] U.S. Cl. ..... 271/127; 271/122; 271/147

[58] Field of Search ..... 271/126, 127, 271/167, 147, 121, 122

[56] References Cited

U.S. PATENT DOCUMENTS

| | | | |
|---|---|---|---|
| 4,098,501 | 7/1978 | Tani et al. | 271/127 X |
| 5,527,029 | 6/1996 | Bortolotti et al. | 271/167 X |

FOREIGN PATENT DOCUMENTS

| | | | |
|---|---|---|---|
| 4222816 | 1/1993 | Germany | 271/127 |
| 202228 | 11/1983 | Japan | 271/167 |
| 37036 | 2/1988 | Japan | 271/127 |
| 271329 | 10/1989 | Japan | 271/147 |

*Primary Examiner*—Boris Milef
*Attorney, Agent, or Firm*—Jordan B. Bierman; Bierman, Muserlian and Lucas

[57] ABSTRACT

A sheet feeder for feeding a sheet from a sheet stacker. The sheet feeder includes: a main body of the sheet stacker for holding plural stacked sheets; a movable bottom plate, provided on the bottom portion of the main body and supported bivotally on an axis, for supporting the plural stacked sheets; a lifting lever for lifting the movable bottom plate; and plural pickup rollers, aligned on an axis in a direction perpendicular to a sheet feeding direction, for having a pressure contact with a sheet of the plural stacked sheets on the movable bottom plate, and for feeding the sheet from the main body in the sheet feeding direction. In the sheet feeder, a protruded portion is formed either on the movable bottom plate or on the lifting lever so that a contact portion where the movable bottom plate comes in contact with the lifting lever is of a point contact, and the contact portion is provided at the center of the closest two of the pickup rollers in the direction of their axis.

7 Claims, 9 Drawing Sheets

SHEET FEEDING APPARATUS AND TWO SIDE IMAGE FORMING APPARATUS THEREWITH

BACKGROUND OF THE INVENTION

The present invention relates to a sheet feeding apparatus for sheet-shaped paper used in apparatuses such as a copying machine, a facsimile machine and a printer, and relates to a sheet feeding apparatus and an automatic document feeding apparatus that feeds a document both used in an automatic two side image forming unit (ADU) which forms images on both sides of a sheet-shaped paper.

An image forming apparatus such as a copying machine, a facsimile or a printer has so far been provided with a sheet feeding apparatus which takes out documents or sheet-shaped papers stacked on a document tray, a sheet-feeding cassette or a sheet stacker one sheet by one sheet from the uppermost sheet, and feeds it to an image forming section.

As a sheet feeding apparatus wherein an operation to load sheets in a sheet feeding cassette has been improved, a sheet feeding apparatus called as that of a friction separation roller system has generally been put to practical use. A sheet feeding apparatus of this friction separation roller system is also mounted on the automatic two side image forming unit (ADU).

The sheet feeding apparatus of this system is disclosed in TOKKAISHO Nos. 62-105834 and 63-57447.

FIG. 9(*a*) is a front section of a conventional sheet feeding apparatus, and FIG. 9(*b*) shows a sectional view taken on line A—A.

In the sheet feeding apparatus, at the separation sheet feeding section where feed roller 2 and reverse roller 3 are provided to be pressure contact with each other at the downstream side in sheet feeding made by pickup roller 1 which feeds out plural sheets P, the sheets P thus fed out are caused to be inserted between the feed roller 2 and the reverse roller 3 to be reversed so that the sheets may be fed one sheet by one sheet.

A leading edge in the sheet feeding direction on sheets P stacked on movable bottom plate 5 in sheet housing holder main body (sheet feeding cassette main body or intermediate stacker main body) 4 of a sheet housing means (sheet feeding cassette or intermediate stacker section) is arranged so that the leading edge is brought into pressure contact with the pickup roller (first sheet feeding roller) 1 by the upward movement of bottom plate lifting lever 6, and the sheet P is fed out by the rotation of the pickup roller 1.

Following the pickup roller 1, there is provided a sheet reversing mechanism for preventing double feeding wherein feed roller 2 and reverse roller 3 are provided to face each other, and a mechanism wherein in the case of double feeding (feeding of plural sheets) of sheets P, the uppermost sheet P only among sheets of double feeding is fed out and other sheets are stopped or returned, is provided.

In the sheet feeding course of this sheet feeding apparatus, the leading edge of sheet P is first lifted by the upward movement of the movable bottom plate 5, and it stops at the position where the upper face of sheet P comes in pressure contact with an outer circumferential surface of the pickup roller 1. Then, a sheet feeding signal makes the pickup roller 1 and the feed roller 2 to start rotating. The reverse roller 3 is being driven to rotate in the direction opposite to the advance direction of sheet P and is urged by a spring to be in pressure contact with the feed roller 2.

When the reverse roller 3 is in direct contact with the feed roller 2 (when there is no sheet in the nip), or when one sheet P is fed into the nip, the limit torque for the reverse roller 3 is exceeded to cause a slip and the reverse roller 3 is driven to rotate by the feed roller 2. However, when two or more sheets P are fed into the nip, the limit torque exceeds the friction force between sheets and causes the feed roller 2 to rotate reversely to push back the lower sheet, whereby double feeding (feeding plural sheets) can be prevented. Sheet P thus reversed and separated to be one sheet through the above-mentioned manner is conveyed to unillustrated registration roller 28 (second sheet feeding roller).

The sheet feeding apparatus mentioned above still has the following problems.

(1) A contact portion where bottom surface 5A of the movable bottom plate 5 comes in pressure contact with tip portion 6A of the bottom plate lifting lever 6 has been of a line contact or a surface contact. It is difficult to accurately maintain the parallelism between hinge portion 5B of the movable bottom plate 5 and rotary shaft 7 of the bottom plate lifting lever 6. It is further difficult to precisely maintain manufacturing accuracy for flatness of the bottom surface 5A of the movable bottom plate 5 which is a contact portion where the tip portion 6A of the bottom plate lifting lever 6 is brought into pressure contact by the upward driving of the tip portion 6A of the bottom plate lifting lever 6 and for linearity of the tip portion 6A of the bottom plate lifting lever 6. Therefore, the tip portion 6A of the bottom plate lifting lever 6 for upward driving and the bottom surface 5A of the movable bottom plate 5 can not be in line contact each other, resulting in one side contact. When sheet P on the movable bottom plate 5 which is in the one side contact is brought into pressure contact with an outer circumferential surface of the pickup roller 1, the sheet P on the movable bottom plate 5 is not brought into pressure contact evenly with plural pickup rollers 1 arranged on rotary shaft 8 of the pickup rollers 1, and sheet feeding troubles such as skewed feeding and biased feeding are caused in sheet feeding.

(2) There is a space between sheet stopper surface 4A located inside the sheet housing holder main body 4 which is hit by the leading edge of sheet P housed in the sheet housing holder main body (sheet feeding cassette main body or intermediate stacker main body) 4 and a rise and fall locus of the edge portion of the movable bottom plate 5. The distance of this space in the sheet feeding direction is smallest when the movable bottom plate 5 is at its lowest position, and is largest when the movable bottom plate 5 is at its highest position. Therefore, when the leading edge of sheet P fed out of the movable bottom plate 5 at the upper most position, especially of a sheet curled downward or of a thin sheet, is conveyed to guide member 9 located at the downstream side of sheet feeding, the leading edge is caught by a part of the sheet stopper surface 4A having the space, resulting in occurrence of sheet feeding troubles.

SUMMARY OF THE INVENTION

An object of the invention is to solve the problems mentioned above and thereby to provide an sheet feeding apparatus realizing stable sheet feeding and a two side image forming apparatus.

The sheet feeding apparatus of the invention achieving the objects mentioned above is represented by an sheet feeding apparatus that feeds a sheet out of the inside of the holder main body of a sheet housing means housing therein a plurality of stacked sheets, wherein a protruded portion is formed either on a movable bottom plate or on a bottom plate lifting lever so that a contact portion where the movable bottom plate that is supported pivotally on the bottom portion of the holder main body to receive stacked sheets and to lift them comes in contact with the bottom plate lifting lever that drives the movable bottom plate to rise and fall, may be of a point contact, and plural pickup rollers which come in pressure contact with a sheet on the movable bottom plate to feed it out are arranged at two positions at both sides of the contact portion to be away therefrom by mostly the same distance on a rotary shaft supported in the direction perpendicular to the sheet feeding direction.

FIG. 1 is a schematic structure diagram of an image forming apparatus, and FIG. 2 is an illustrative diagram showing a sheet conveyance path of the image forming apparatus.

In this embodiment, a copying apparatus is shown as an image forming apparatus. This copying apparatus is composed of image forming section 10, sheet feeding cassette 21, sheet feeding section 20, sheet ejecting section 30

DETAILED DESCRIPTION OF THE INVENTION

Figure 1:
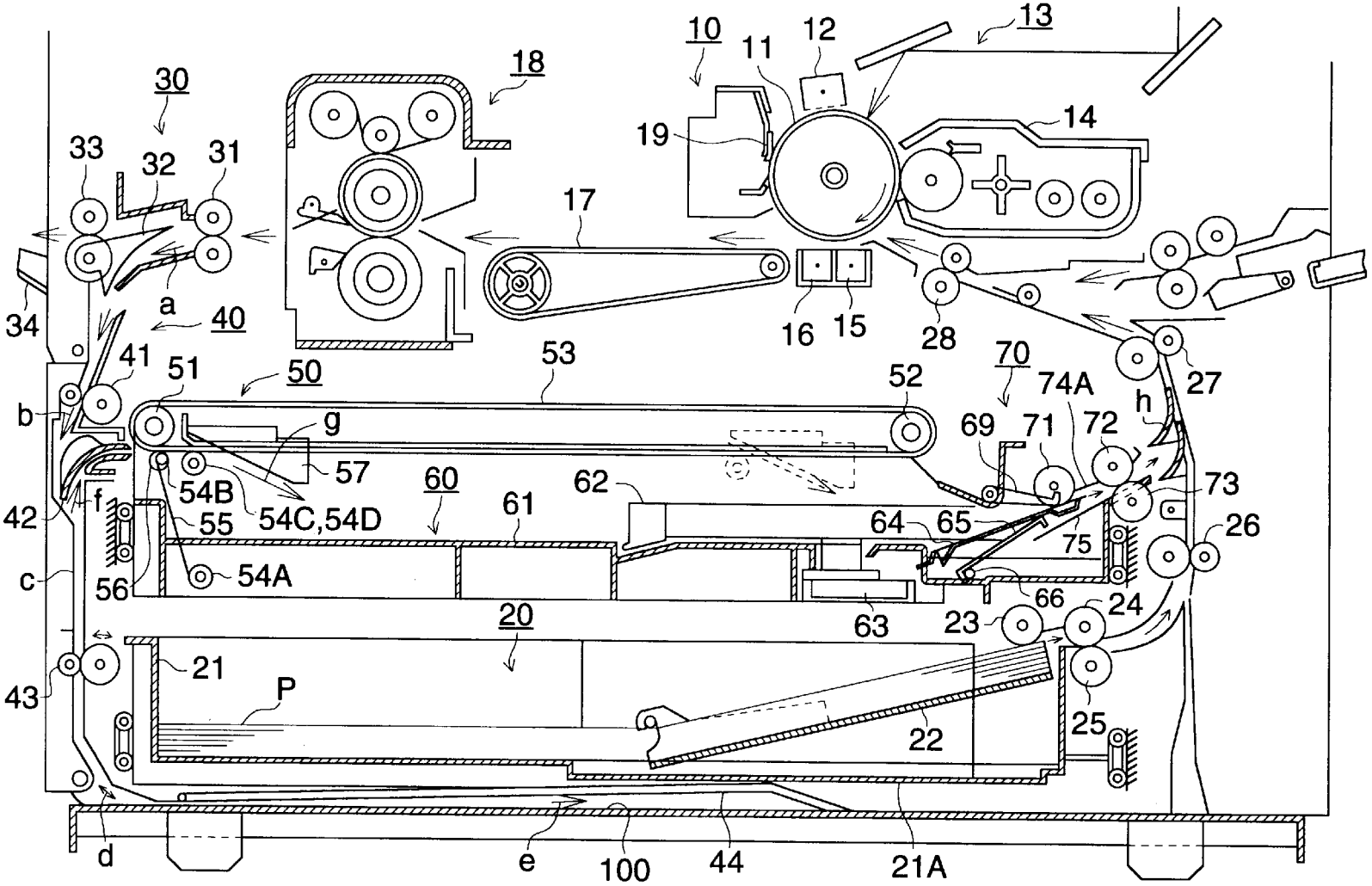
FIG. 1 is a schematic structure diagram of an image forming apparatus.
Figure 2:
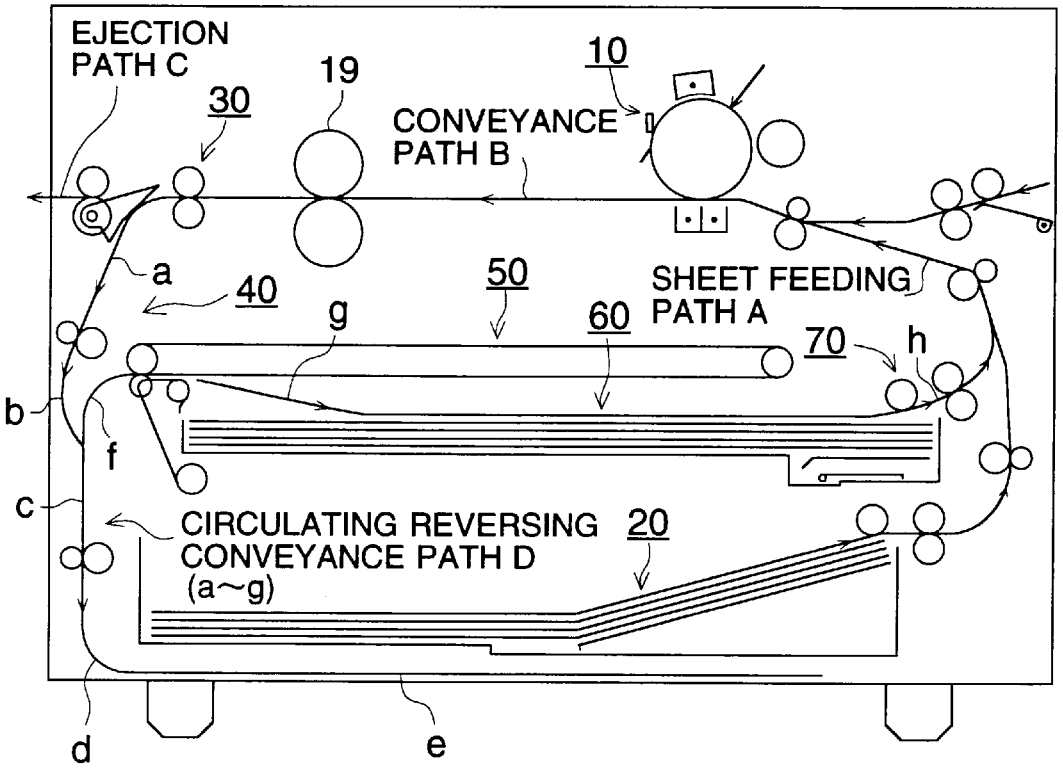
FIG. 2 is an illustrative diagram showing a sheet conveyance path of the image forming apparatus.

An embodiment of an image forming apparatus equipped with a sheet feeding apparatus of the invention will be explained as follows. FIG. 1 is a schematic structure diagram of an image forming apparatus, and FIG. 2 is an illustrative diagram showing a sheet conveyance path of the image forming apparatus.

In this embodiment, a copying apparatus is shown as an image forming apparatus. This copying apparatus is equipped with image forming section 10, sheet feeding cassette 21, sheet feeding section 20, sheet ejecting section 30, reversing conveyance section 40, sheet guiding section 50, intermediate stacker section 60 and sheet re-feeding section 70, and it has therein sheet feeding path A that conveys recording sheet P to a transfer section of the image forming section 10, conveyance path B which ejects or re-feeds recorded recording sheet P from the transfer section, ejection path C that ejects recording sheet P on which images have been formed out of the apparatus, and circulating reversing conveyance path D which circulates recording sheet P on which images have been formed at the image forming section 10 to the image forming section 10 again after reversing the recording sheet P.

In the image forming section 10, there is arranged image carrier (photoreceptor drum) 11 which is uniformly given charges by charging unit 12, and a circumferental surface of the image carrier 11 is exposed to image information by exposure means 13 to form thereon an electrostatic latent image. The electrostatic latent image is developed by developing unit 14 to form a toner image.

At least one sheet feeding section 20 is provided on an image forming apparatus. On sheet feeding section 20, there is arranged sheet feeding cassette 21 which houses a large number of recording sheets P in the manner that the sheet feeding cassette can be drawn out. The numeral 22 represents a movable bottom plate which brings recording sheet P into pressure contact with sheet feeding roller 23. When the sheet feeding roller 23 is driven to rotate, the uppermost recording sheet P on the movable bottom plate 22 is taken out intermittently. A pair of double feed prevention rollers 24 and 25 are arranged at the downstream side in the direction of sheet feeding conducted by the sheet feeding roller 23, thus, the recording sheet P is fed to the following step one sheet by one sheet to be conveyed to the second sheet feeding roller (registration roller) 28 through intermediate sheet feeding rollers 26 and 27 arranged respectively on the sheet feeding path A.

The second sheet feeding roller 28 is driven in synchronization with the rotation of image carrier 11 to convey recording sheet P to transfer unit 15 so that toner images may be transferred. After that, the recording sheet P is separated from the image carrier by separating unit 16, and then is conveyed to fixing unit 18 by conveyance belt 17. In addition, on the circumferential surface of the image carrier 11, there is provided cleaning unit 19 which removes toner staying on the surface of the image carrier 11 after transfer. Then, the image carrier 11 is charged by the charging unit 12 for the following image forming.

Toner images are fixed on recording sheet P heated and pressed by the fixing unit 18. The fixed recording sheet P is fed out to sheet ejecting section 30. Namely, the recording sheet P passes through a nip position of sheet ejection guide roller 31 arranged at the downstream side of the fixing unit 18, and then the conveyance path for the recording sheet P is switched between the ejection side and the reversing and sheet re-feeding side by sheet ejection switching member (switching gate) 32 that is located at further downstream side for conveyance. The recording sheet P whose conveyance path has been switched to the ejection side passes through a path running over the switching gate 32, then, is delivered onto sheet ejection tray 34 by sheet ejection roller 33.

On the reversing and sheet re-feeding side for recording sheet, there are provided reversing conveyance section 40, sheet guiding section 50, intermediate stacker section 60 and sheet re-feeding section 70. When the switching gate 32 is switched to the reversing and sheet re-feeding side, recording sheet P which has passed through path a running below the switching gate 32 is conveyed downward through conveyance roller 41 of the reversing conveyance section 40. Then, the recording sheet P passes through path b on the left of shunt member 42 in the drawing, then, further passes vertical path c located at the downstream side in conveyance to be nipped for conveyance by conveyance roller 43 capable of rotating regularly and reversely, then the course of the recording sheet P is deflected to the horizontal direction in the curved path d. Thus, the recording sheet enters horizontal path e provided in the space formed between the top surface of bottom plate 100 of the image forming apparatus main body and the bottom surface of the sheet feeding cassette 21, to be stopped momentarily at the prescribed position. Though the position of the leading edge of the recording sheet that is momentarily stopped varies depending on the sheet size, the position of the trailing edge of recording sheet P of each size is between the shunt member 42 and the position of the nip of the conveyance roller 43. The numeral 44 represents a guide member that comes in light pressure contact with the leading edge of a large-sized sheet for guiding.

The trailing edge of the recording sheet P stopped momentarily is nipped by the conveyance roller 43 switched to its reverse driving, and then rises along the vertical path c to pass through path f in the shunt member 42, thus, it is fed into sheet housing means (intermediate stacker section) 60 by the sheet guiding section 50 (path g).

Over the intermediate stacker section 60, there are provided conveyance belt 53 that is trained over driving roller 51 and driven roller 52 and movable wire 55 that is elastically stretched around fixed roller 54A, intermediate roll 54B and engaging roll 54C. On the bottom surface of the conveyance belt 53, there are provided driven roller 56 capable of being driven to rotate at the fixed position and moving roller 54D which moves together with the movable wire 55 and is capable of being driven to rotate (arranged to be coaxial with the engaging roll 56C).

There is further provided guide member 57 capable of moving together with the engaging roll 54C, movable wire 55 and moving roller 54D. A moving section having therein the engaging roll 54C, moving roller 54D, movable wire 55 and the guide member 57 moves and is set at the prescribed position in accordance with a size of recording sheet P.

On the intermediate stacker section 60, there are provided stacker main body 61 which houses stacked recording sheets P, lateral regulation member 62 which regulates recording sheet P laterally, driving means 63 which drives the lateral regulation member 62 to be moved, movable bottom plate 64 and bottom plate lifting lever 65.

Recording sheet P which is fed into the intermediate stacker section 60 from the reversing conveyance section 40 by sheet guiding section 50 is nipped and conveyed by rotating conveyance belt 53 and the movable wire 55 which is set at the fixed position, and then is ejected to movement path g which extends downward obliquely along a slope of the guiding member 57, then is housed in the stacker main body 61, and is stopped when the leading edge of the recording sheet P in its conveyance direction hits sheet stopper surface 61A located at the downstream side in the conveyance direction of the stacker main body 61.

When the recording sheet P is housed in the stacker main body 61, a side of the recording sheet P in its lateral direction is pressed by lateral regulation member 62 to be regulated in the lateral direction.

Figure 3:
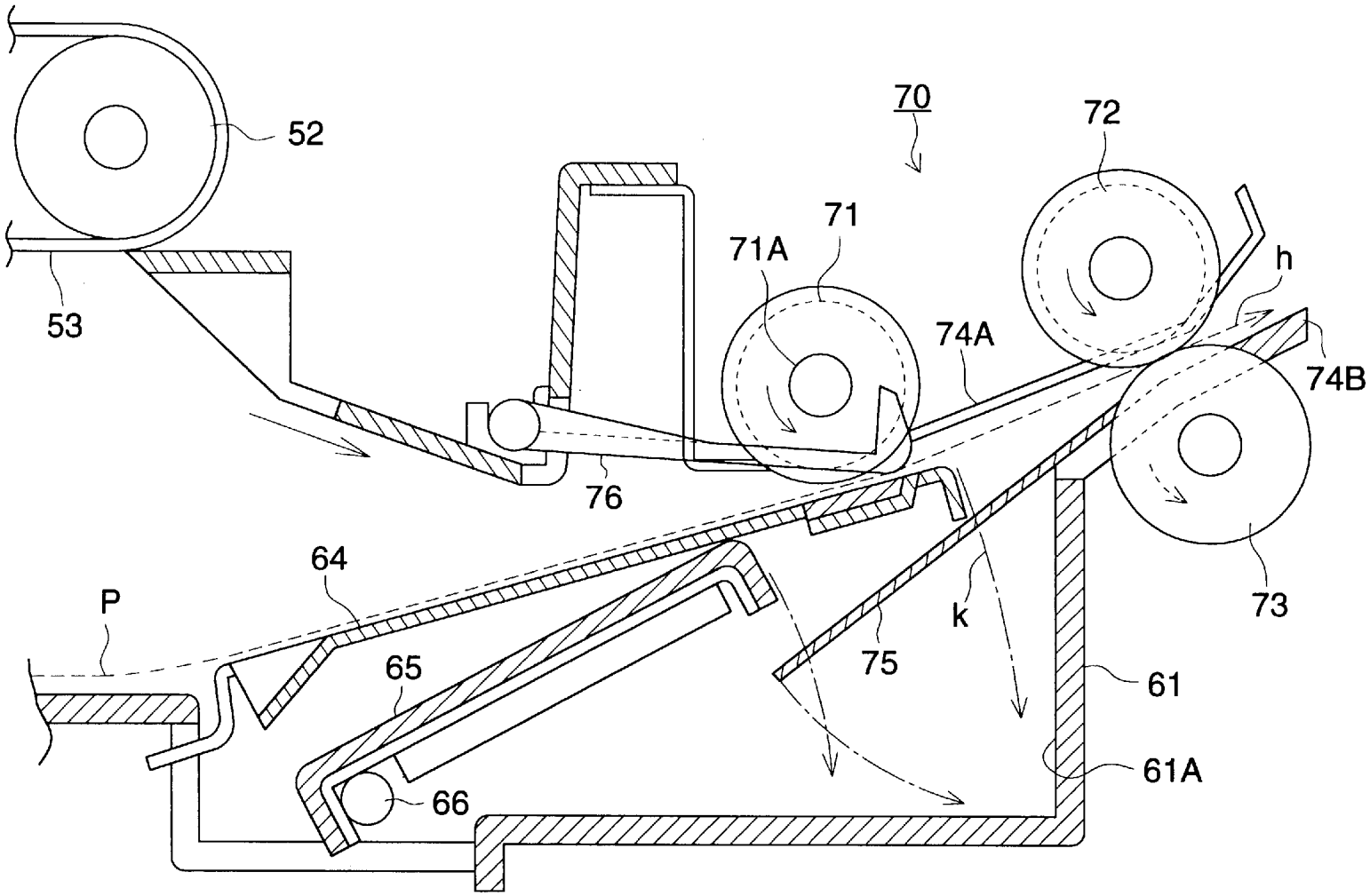
FIG. 3 is a sectional view of a sheet re-feeding section.

FIG. 3 is s sectional view of sheet re-feeding section 70.

On the recessed portion of the stacker main body 61 located at the downstream side in the conveyance direction of the stacker main body 61, there are provided movable bottom plate 64 capable of rotating through engagement with a part of the stacker main body 61, and bottom plate lifting lever 65 which is fixed on rotary shaft 66 connected with an unillustrated driving source to drive the movable bottom plate 64 to rise and fall.

In the sheet feeding apparatus provided above the stacker main body 61, there is provided a separation sheet feeding section in which feed roller 72 and reverse roller 73 are provided to be in pressure contact each other, at the downstream side of pickup roller 71 which feeds out plural sheets P, and sheet P fed out is inserted between the feed roller 72 and the reverse roller 73 and is reversed to be conveyed one sheet by one sheet.

The leading edge in the sheet feeding direction of sheet P stacked and laminated on movable bottom plate 64 in stacker main body 61 of a recording sheet housing means (intermediate stacker portion) is provided under the condition that the leading edge is brought into pressure contact with pickup roller (first sheet feeding roller) 71 by the rising action of bottom plate lifting lever 65, whereby the sheet P is fed out by rotation of the pickup roller 71.

Between the pickup roller 71 and the separation sheet feeding section (feed roller 72, reverse roller 73), there is provided sheet re-feeding path h composed of upper guide plate 74A and lower guide plate 74B. In FIG. 3, the lower guide plate 74B is solidly formed on the front end portion of the stacker main body 61.

An edge portion on one side of flexible sheet member 75 is stuck on the side of the lower guide plate 74B closer to the stacker main body. An edge portion on the other side of the flexible sheet member 75 is a free end which is provided to be protruded to the inside of the stacker main body 61 and to be inserted under the movable bottom plate 64. The flexible sheet member 75 is, for example, a film which is made from polyethyleneterephthalate (PET) and has a thickness of 0.05–0.3 mm, and it can be deformed elastically.

There is a clearance space between sheet stopper surface 61A that is located inside stacker main body 61 and is hit by the leading edge of sheet P housed in the stacker main body 61 to regulate it and a rise and fall locus of the edge portion of the movable bottom plate 64. The distance of this space in the sheet feeding direction is smallest when the movable bottom plate 64 is at its lowest position, and is largest when the movable bottom plate 64 is at its highest position. When this clearance space is covered by the flexible sheet member 75, the leading edge of sheet P fed out by the pickup roller 71 and movable bottom plate 64 is guided along the top surface of the flexible sheet member 75 to be conveyed, and then is guided by guide plates 74A and 74B located at the downstream side in the sheet feeding direction, so that it is surely conveyed to the nipping position between feed roller 72 and reverse roller 73.

The numeral 76 is a recording sheet holding lever which has a rotary shaft at the upper part of sheet re-feeding section 70 and is supported rotatably, and a tip portion of which presses the top surface of recording sheet P stacked on the upper surface of the bottom plate lever 65.

Figure 4:
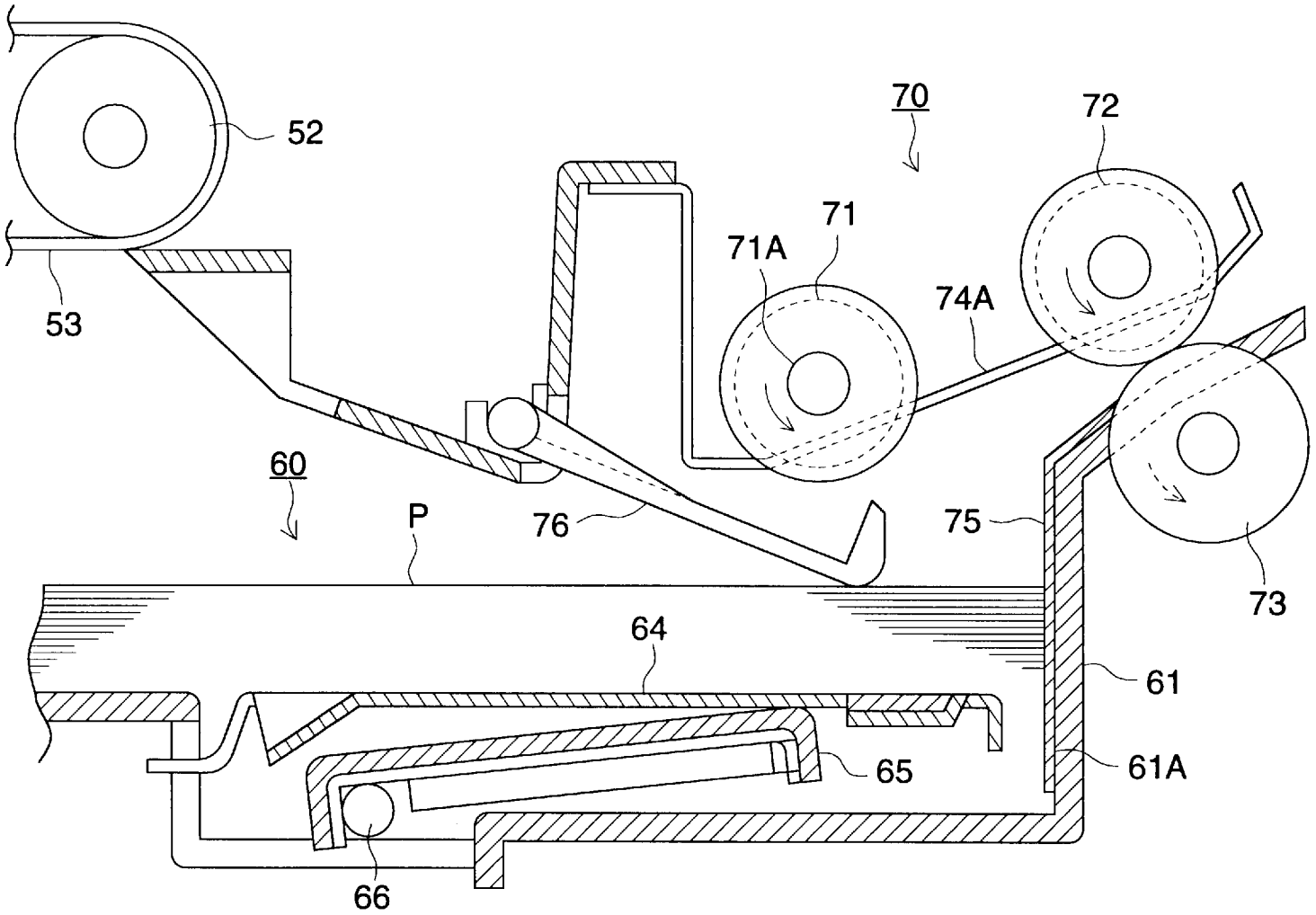
FIG. 4 is a sectional view of a sheet re-feeding section showing the state before sheet re-feeding.

FIG. 4 is a sectional view of sheet re-feeding section 70 showing the state before sheet re-feeding. The flexible sheet member 75 mentioned above is pressed by a front end portion of recording sheet P and therefore is deformed elastically, to be in contact with the sheet stopper surface 61A.

Figure 5:
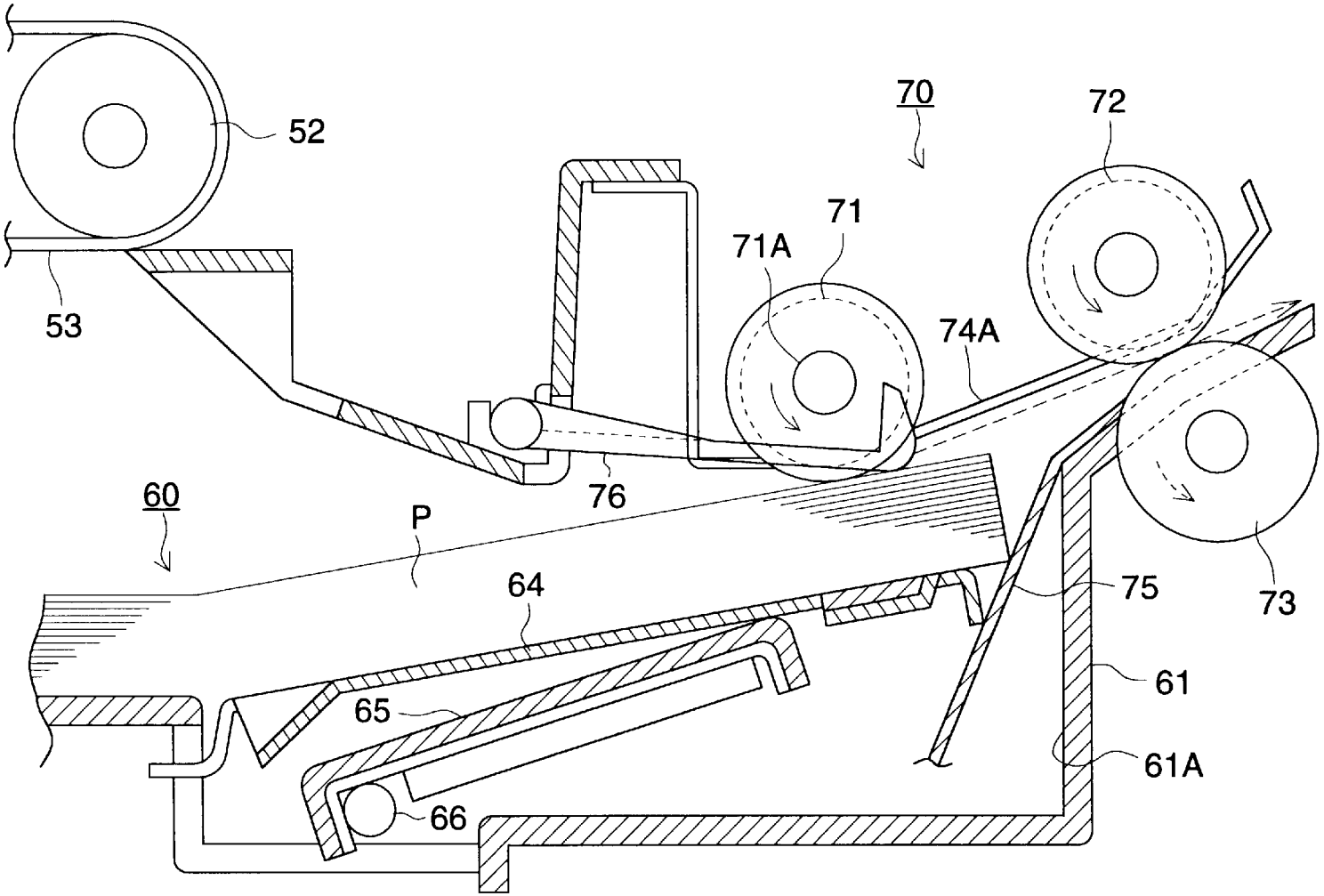
FIG. 5 is a sectional view of a sheet re-feeding section showing the state of sheet feeding.

FIG. 5 is a sectional view of sheet re-feeding section 70 showing the state of sheet feeding. The flexible sheet member 75 is pressed by a front end portion of recording sheet P or by a front end portion of the movable bottom plate 64 and therefore is deformed elastically, to cover the clearance space formed between the sheet stopper surface 61A and a front end portion of the movable bottom plate 64, as illustrated. Whereby, the front end portion of the curled sheet P fed out by the pickup roller 71 and movable bottom plate 64 is guided and conveyed along the top surface of the elastic sheet member 75 without hitting the sheet stopper surface 61A of the stacker main body 61, then is guided by guide plates 74A and 74B located at the downstream side in the sheet feeding direction, to be conveyed surely to the position of a nip between feed roller 72 and reverse roller 73.

Figure 6:
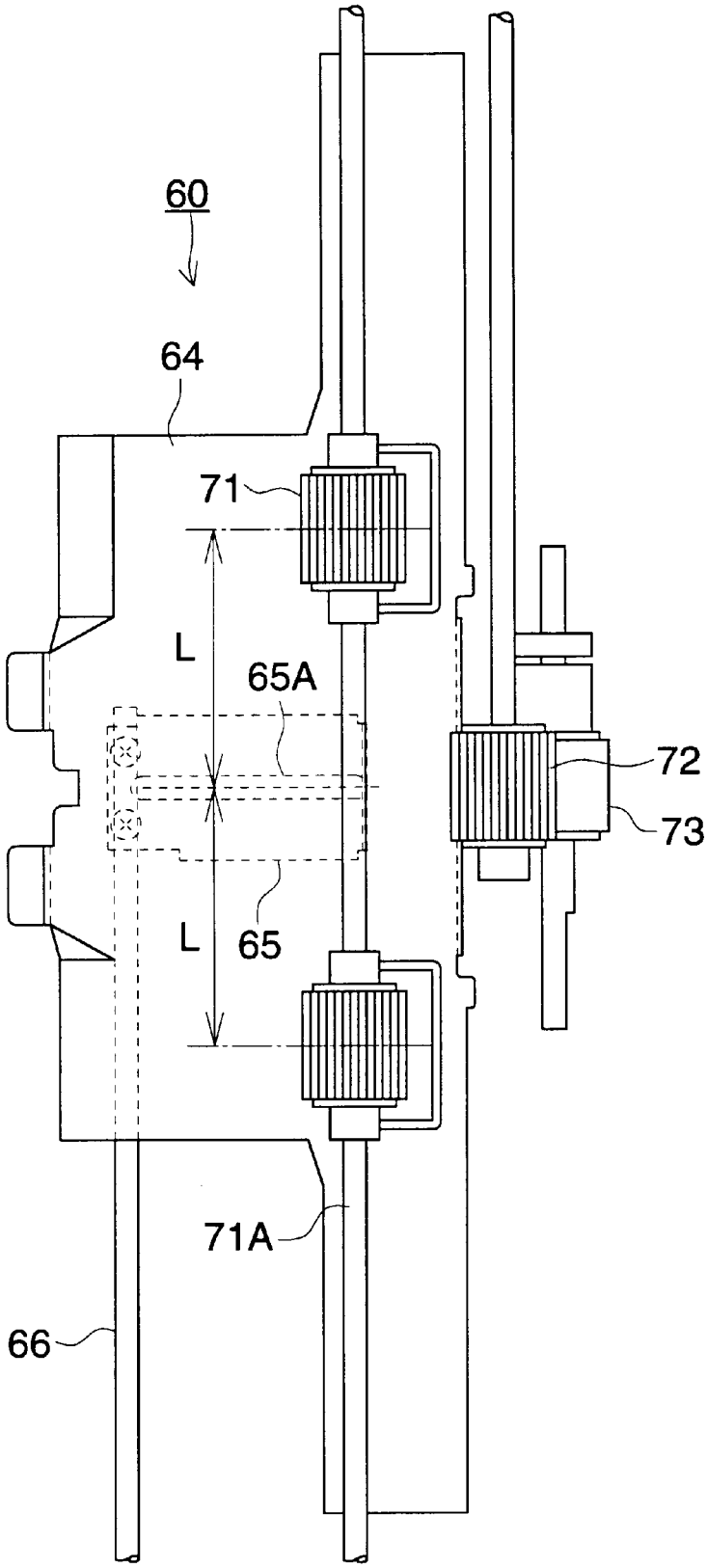
FIG. 6 is a top view of a sheet re-feeding section.
Figure 7:
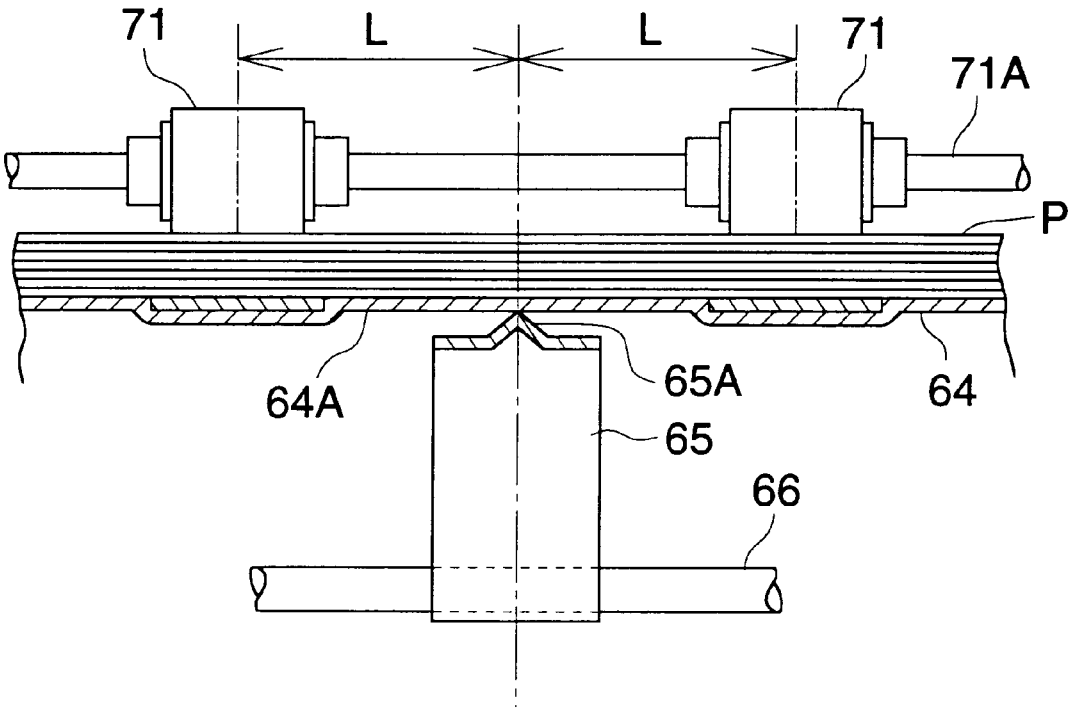
FIG. 7 is a sectional view of a sheet re-feeding section.

FIG. 6 is a top view of sheet re-feeding section 70, and FIG. 7 is a sectional view of sheet re-feeding section 70.

Figure 8:
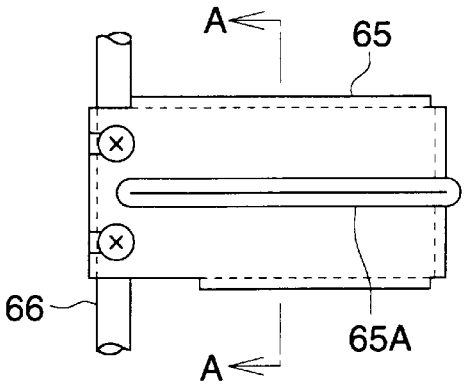
FIGS. 8(*a*)–8(*e*) respectively show a top view, a front view, a side view, a sectional view taken on line A—A and a perspective view, all of a bottom plate lifting lever.
Figure 8:
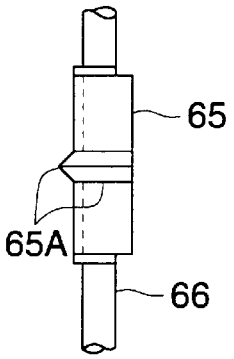
Figure 8:
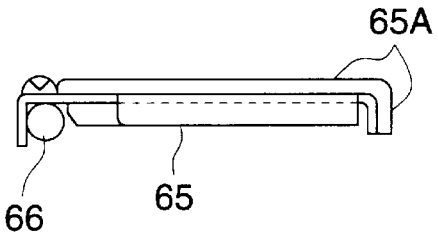
Figure 8:
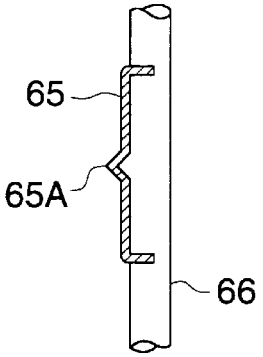
Figure 8:
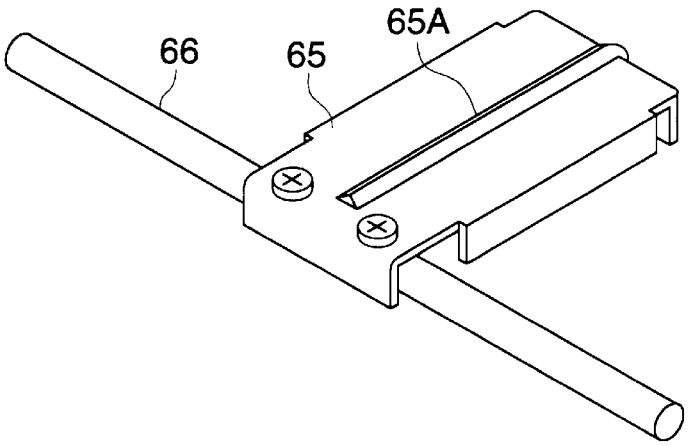
Figure 9:
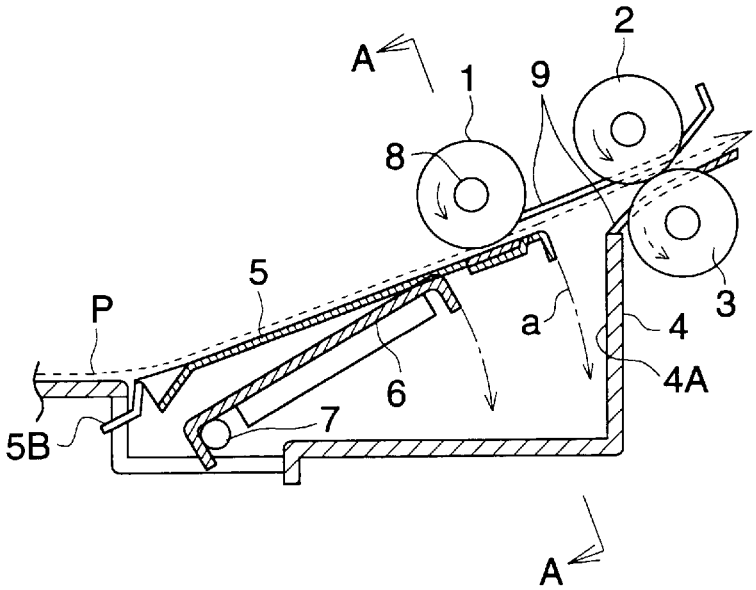
FIG. 9 (a) PRIOR ART
FIGS. 9(*a*) and 9(*b*) respectively show a front section and a sectional view taken on line A—A, both of a conventional sheet feeding apparatus.
Figure 9:
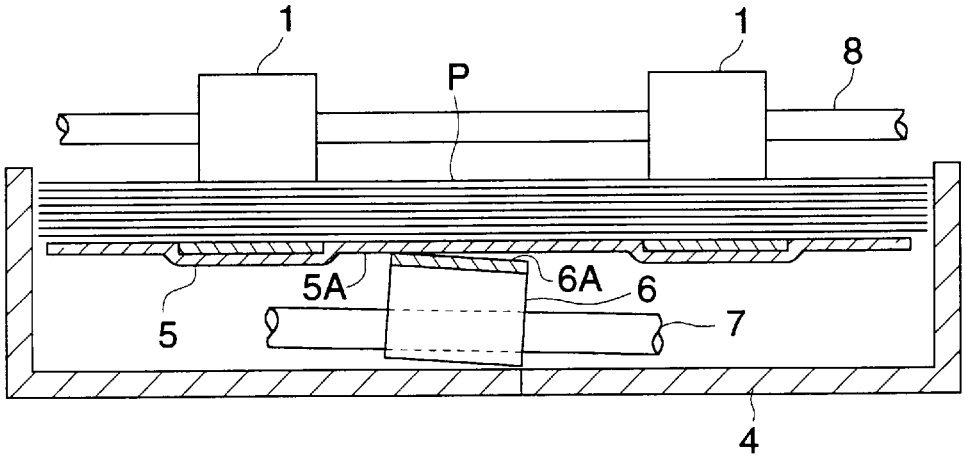
FIG. 9 (b) PRIOR ART

FIG. 8 is a diagram showing an embodiment of a bottom plate lifting lever, wherein FIG. 8(*a*) represents a top view, FIG. 8(*b*) represents a front view, FIG. 8(*c*) represents a side view, FIG. 8(*d*) represents a sectional view taken on line A—A, and FIG. 8(*e*) represents a perspective view.

Protruded portion 65A is formed on the contact area where the top surface of the bottom plate lifting lever 65 comes in contact with the movable bottom plate 64. The protruded portion 65A is formed in a protrusion shape which comes in point contact with bottom surface 64A of the movable bottom plate 64 when the bottom plate lifting lever 65 swings up and down. Or, it is also possible to take measures wherein a protruded portion is formed on bottom surface 64A of the movable bottom plate 64, and the top surface of the bottom plate lifting lever 65 is formed to be flat, so that point contact may be produced.

Further, a plurality of pickup rollers 71 which come in pressure contact with recording sheet P on the movable bottom plate 64 are arranged at two points on both sides of the point of contact between the protruded portion 65A and movable bottom plate 64 on rotary shaft 71A that is supported in the direction perpendicular to the sheet feeding direction, to be away from the point of contact by almost equal distance L.

The protruded portion 65A at the front end portion of the bottom plate lifting lever 65 that drives to lift upward and bottom surface 64A of the movable bottom plate 64 come into point contact each other at the central position between two pickup rollers 71. Whereby, even when the bottom plate lifting lever 65 is fixed on rotary shaft 66 to be inclined, or even when the rotary shaft 66 is not fixed to be in parallel with bottom surface 64 of the movable bottom plate 64, the protruded portion 65A of the bottom plate lifting lever 65 and bottom surface 64A of the movable bottom plate 64 come into point contact each other to lift the movable bottom plate 64, thus, the sheet P on the movable bottom plate 64 is brought into pressure contact with plural pickup rollers 71 evenly.

Accordingly, sheet P on the movable bottom plate 64 comes in pressure contact evenly with plural pickup rollers 71 arranged on rotary shaft 71A, and sheet feeding troubles such as skewed conveyance and biased conveyance can be prevented in the course of sheet feeding.

As stated above, a protruded portion at a front end portion of a bottom plate lifting lever which drives to lift upward comes in point contact with a bottom surface of a movable plate at a central position between two pickup rollers, in the invention. Due to this, even when the relative position between a bottom plate lifting lever and a bottom plate lifting lever is arranged to be inclined, a sheet on the movable bottom plate is brought into pressure contact evenly with an outer circumferential surface of the pickup roller, without being in one side contact. Thus, sheet feeding troubles such as skewed conveyance and biased conveyance can be prevented in the course of sheet feeding.

In the sheet feeding apparatus and the two side image forming apparatus of the invention, the front end portion of the curled sheet P fed out by the pickup roller and movable bottom plate is guided and conveyed along the top surface of the flexible sheet member without hitting the sheet stopper surface of a sheet housing holder main body, then is guided by guide plates located at the downstream side in the sheet feeding direction, to be conveyed surely to the position of a nip between a feed roller and a reverse roller.

When the invention is applied to a sheet feeding apparatus mounted on an image forming apparatus equipped with an intermediate stacker which houses sheets each having on its one side an image formed and with a sheet re-feeding section that re-feeds each of sheets in the intermediate stacker to the image forming section, capable of forming images on two sides of a sheet, no sheet feeding trouble is caused in particular, and stable sheet feeding can be conducted, when curled recording sheets each being recorded on its one side are housed and subjected to re-feeding.

What is claimed is:

1. A sheet feeding apparatus for feeding a sheet from a sheet housing means, comprising:

a holder main body of the sheet housing means for holding a plurality of stacked sheets;

a movable bottom plate, provided on the bottom portion of said holder main body and supported pivotally on an axis, for supporting said plurality of stacked sheets;

a lifting lever actively movable by a driving means for lifting said movable bottom plate; and a plurality of pickup rollers, aligned on an axis in a direction perpendicular to a sheet feeding direction, for having a pressure contact with a sheet of said plurality of stacked sheets on said movable bottom plate, and for feeding said sheet from said holder main body in said sheet feeding direction; and a protruded portion is formed on said lifting lever so that said protruded portion forms a point contact with said movable bottom plate, and said point contact is provided at the center of the closest two of said plurality of pickup rollers in the direction of said axis on which said plurality of pickup rollers are aligned.

2. The sheet feeding apparatus of claim 1, further comprising:

a separation sheet feeding means for separating one sheet from other sheets of said plurality of stacked sheets by nipping said separated sheet at a sheet nipping position;

a stopper surface, provided in said holder main body, to which said plurality of stacked sheets are hit;

a flexible sheet member for intercepting a clearance between said stopper surface and a front end portion of said movable bottom plate in said sheet feeding direction;

wherein one end of said flexible sheet member is supported in the vicinity of said sheet nipping position of said separation sheet feeding means and the other end is a free end that enters between said movable bottom plate and said holder main body.

3. The sheet feeding apparatus of claim 1, wherein said holder main body is an intermediate stacker portion of a two side image forming apparatus;

wherein a recording sheet, on one side surface of which an image is formed, is stacked in said intermediate stacker portion.

4. The sheet feeding apparatus of claim 1 wherein said protruded portion is an elongated member extending from one end of said lifting lever to another end of said lifting lever such that said protruded portion makes a point contact along the center of the movable bottom plate.

5. A sheet feeding apparatus for feeding a sheet from a sheet housing means comprising:

a holder main body of the sheet housing means for holding a plurality of stacked sheets;

a movable bottom plate, provided on the bottom portion of said holder main body and supported pivotally on an axis, for supporting said plurality of stacked sheets;

a lifting lever for lifting said movable bottom plate;

a plurality of pickup rollers, aligned on an axis in a direction perpendicular to a sheet feeding direction, for having a pressure contact with a sheet of said plurality of stacked sheets on said movable bottom plate, and for feeding said sheet from said holder main body in said sheet feeding direction;

a separation sheet feeding means for separating one sheet from other sheets of said plurality of stacked sheets by nipping said separated sheet at a sheet nipping position;

a stopper surface, provided in said holder main body, to which said plurality of stacked sheets are hit; and a flexible sheet member for intercepting a clearance between said stopper surface and a front end portion of said movable bottom plate in said sheet feeding direction;

wherein one end of said flexible sheet member is supported in the vicinity of said sheet nipping position of said separation sheet feeding means and the other end is a free end that enters between said movable bottom plate and said holder main body.

6. A sheet feeding apparatus for feeding a sheet from a sheet housing means comprising:

a holder main body of the sheet housing means for holding a plurality of stacked sheets;

a movable bottom plate, provided on the bottom portion of said holder main body and supported pivotally on an axis, for supporting said plurality of stacked sheets;

a plurality of pickup rollers, aligned on an axis in a direction perpendicular to a sheet feeding direction, for having a pressure contact with a sheet of said plurality of stacked sheets on said movable bottom plate, and for feeding said sheet from said holder main body in said sheet feeding direction;

a separation sheet feeding means for separating one sheet from other sheets of said plurality of stacked sheets by nipping said separated sheet at a sheet nipping position;

a stopper surface, provided in said holder main body, to which said plurality of stacked sheets are hit; and a flexible sheet member for intercepting a clearance between said stopper surface and a front end portion of said movable bottom plate in said sheet feeding direction;

wherein one end of said flexible sheet member is supported in the vicinity of said sheet nipping position of said separation sheet feeding means and the other end is a free end that enters between said movable bottom plate and said holder main body.

7. The sheet feeding apparatus of claim 6 wherein said holder main body is an intermediate stacker portion of a two side image forming apparatus;

wherein a recording sheet, on one side surface of which an image is formed, is stacked in said intermediate stacker portion.

* * * * *